US005123267A

United States Patent [19]

Appelbaum

[11] Patent Number: 5,123,267

[45] Date of Patent: Jun. 23, 1992

[54] LOCK FOR A HASP

[76] Inventor: Paul Appelbaum, 345 Camino Capistrano, Capistrano Beach, Calif. 92624

[21] Appl. No.: 706,177

[22] Filed: May 28, 1991

[51] Int. Cl.[5] ..... E05C 67/24

[52] U.S. Cl. ..... 70/38 A; 70/25; 70/54; 70/51

[58] Field of Search ..... 70/38 R, 38 A, 39, 25, 70/26, 51-56

[56] References Cited

U.S. PATENT DOCUMENTS

| | | | |
|---|---|---|---|
| 4,030,321 | 6/1977 | Kenyon | 70/54 X |
| 4,112,716 | 9/1978 | Wippich | 70/39 X |
| 4,754,626 | 7/1988 | Siegel | 70/51 X |
| 4,953,371 | 9/1990 | Appelbaum | 70/53 X |

*Primary Examiner*—Gary L. Smith
*Assistant Examiner*—Darnell M. Boucher
*Attorney, Agent, or Firm*—Charles C. Corbin

[57] ABSTRACT

Disclosed is a lock for securing the U-shaped member of a hasp-type latch assembly, and which lock has an outer protective case having a front wall with elongated aperture therein that can receive the U-shaped member, and the case enclosing a pair of pivotally mounted arms and the first of the arms having a locking tap that is spaced opposite a locking tab of the second arm and aligned one to each side of the apertures, and the lock having an open position in which a segment of the U-shaped member can be inserted through the aperture and past the spaced-apart locking tabs, and a closed position in which the locking tabs are moved towards each other bringing opposing edges of the blades into engagement to secure the U-shaped member.

11 Claims, 1 Drawing Sheet

LOCK FOR A HASP

BACKGROUND OF THE INVENTION

1. Field of the Invention

The present invention relates to lock for securing a hasp-type latch by engaging the U-shaped locking ring of the latch.

2. Description of the Prior Art

A conventional hasp-type latch includes a U-shaped member that is affixed to a wall structure, or the like. There is also a generally flat latching bar that has one of its ends pivotally mounted to a structure that is to be locked into position relative to the wall structure, the other end of the latching bar having a slot through which the U-shaped member may fit. The most common approach for securing the bar in place is to use a conventional padlock. While conventional padlocks have been quite useful for this purpose, they nevertheless have drawbacks and limitations which the present invention will address. A big drawback in such a padlock-dependent system is that the shackle of the padlock remains exposed to bolt cutters or similar metal shearing tools. A further weakness in using conventional padlocks is that the U-shaped member is also vulnerable to bolt cutters. Heavy duty, high strength padlocks are available for improved security, however they are expensive. An associated problem stems from the fact that hasp-type latches are often used in outdoor applications and most conventional padlocks are subject to corrosion and contamination when exposed to the weather.

SUMMARY OF THE INVENTION

In view of the foregoing prior art drawbacks, it is a general object of the present invention to provide improved means for locking a hasp-type latch.

Another object of the invention is to provide such a lock that engages the U-shaped member of a hasp-latch in a manner that shields the U-shaped member against cutting tools.

Yet another object is to provide for a hasp, a lock that shields its locking mechanism from weather and moisture.

These and other-objects and advantages are achievable by the present invention which is a lock adapted to engage the U-shaped member of a hasp latch, and which includes an outer case having a front wall with a vertically elongated aperture therein, and an inner lock mounted in the lower part of the outer case, the inner lock having a case that includes a top wall with twin bores therein. The subject lock also includes a camming block, slidably mounted in the upper part of the outer case for vertical movement and lockably connected with the inner lock by way of a pair of vertical shafts with lower ends receivable in the bores of the inner lock, and the camming block being movable from an upper unlocked position to a lowered locked position where the shafts are locked within the bores, and the camming head having a vertically elongated cavity therein including a slot aligned with the outer case aperture for receiving the U-shaped member and including spaced-apart first and second camming surfaces. The invention further includes first and second pincher arms each having a curved upper surface, a lower end, and a laterally projecting latching blade with an upper edge, lower edge, and side edge, and the lower ends of the arms pivotally mounted about closely spaced axles supported above the inner lock, and finally, means for urging the arms resiliently apart such that the upper surfaces of the arms slidably engage the camming surfaces of the camming block. In the open position of the lock, the camming block is raised and opposing blades of the arms are spread apart so as to pass a U-shaped member, and downward movement of the camming block to its locked position causes its camming surface to urge the locking arms towards each other, bringing together the opposing slide edges of the blades so as to secure the U-shaped member.

DETAILED DESCRIPTION OF THE INVENTION

Figure 2:
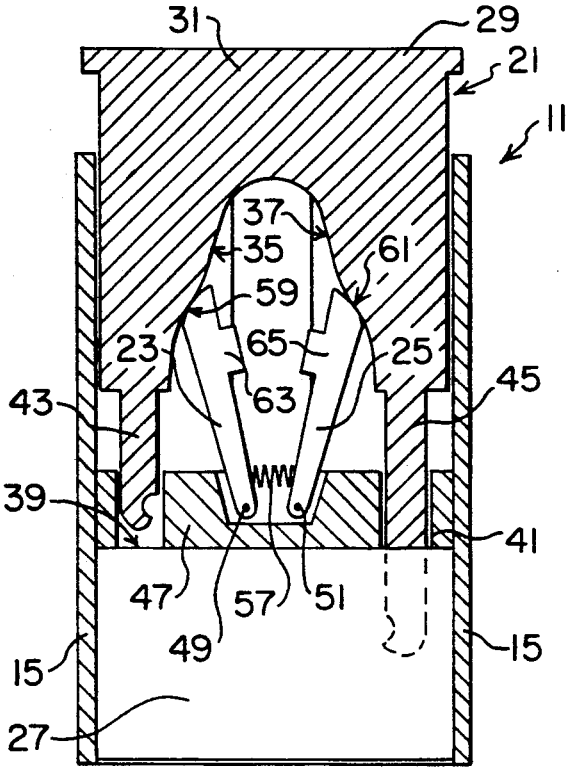
FIG. 2 is a partially sectional view with parts broken away taken along the line 2—2 of FIG. 1.
Figure 1:
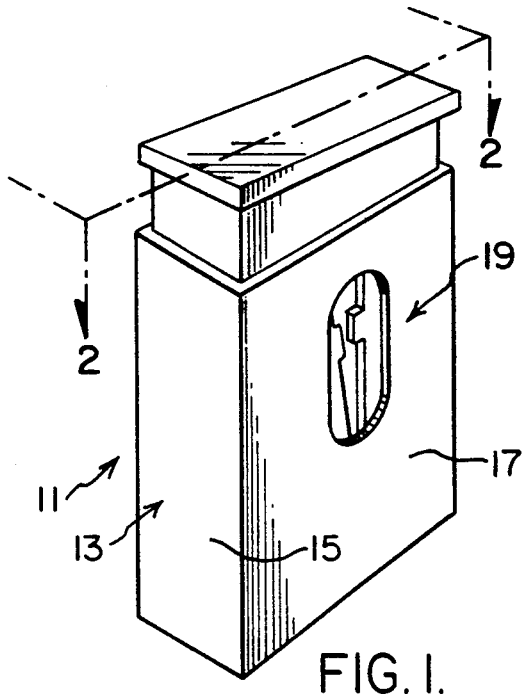
FIG. 1 is a perspective view showing the open configuration of a preferred embodiment of a lock according to the present invention, for securing a hasp-type latch.

Referring now to the drawings, FIG. 1 shows a preferred embodiment of the invention in the form of a hasp lock 11, constructed according to conventional metal fabricating techniques, and having an outer steel case 13 which has spaced-apart side walls 15, a front wall 17 that is provided with the aperture 19, and a rear wall (not shown) that has no apertures. FIG. 2 illustrates that the other components of the lock 11 include a camming block 21, a pair of cammable pincher/locking arms comprising arm 23 and arm 25, and an inner lock 27.

FIG. 2 further shows that the camming block 21 includes a top ledge 29 and a main body 31 having walls that are shaped to allow main body 31 to be supported and slidably received within the walls of the upper part of outer case 13, for vertical movement. FIG. 2 further shows that camming block 21 has a vertically extending slot 33 which is sufficiently large to accommodate the U-shaped ring of a conventional hasp-type latch (illustrated in FIGS. 4 and 5). Adjacent to the slot 33 is a first camming surface 35 and a second camming surface 37 which mirrors the surface 35.

The inner lock 27 is a conventional padlock case and is mounted within the lower part of the outer case 13 as FIG. 2 shows, has a keyway (not shown) in its bottom wall, and first and second bores 39 and 41 in its upper wall. It should be appreciated that an inner lock that is controlled by a combination mechanism can be equally suitable. Shafts 43 and 45, which resemble the shackles of a conventional padlock, are affixed to the camming block 21 and have lower ends shaped in a conventional manner for being lockably received within the bores 39 and 41 respectively. A conventional spring mechanism (not shown) within the inner lock 27 will bias the shaft 45, and the attached camming block 21, into the upward position as illustrated in FIGS. 2 and 1.

Adjoining the top of the inner case 27 is a mounting block 47 which supports a first and second axle 49 and 51, which axles lie parallel each other. Axle 49 engages an opening in the lower end of arm 23 so as to privotally mount arm 23. Similarly, the lower end of arm 25 is pivotally mounted over pin 51. Lower inner portions of arm 23 and arm 25 are suitably slotted to hold a compressed coil spring 57 which urges the arms 23 and 25 apart from each other.

Figure 3:
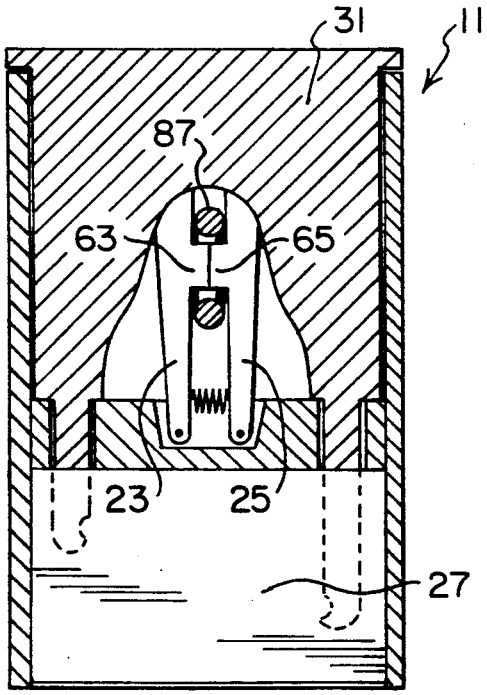
FIG. 3 is a partial sectional view similar to FIG. 1 but showing the lock in its locked position.

Note that the upper ends of arms 23 and 25 are equipped with curved surfaces at 59 and 61 respectively. The coil spring 57 will cause these curved surfaces to be slidably urged into engagement with the camming surface 35 and the camming surface 37 respectively. Note in FIG. 2 that the locking arms have locking blades 63 and 65 with opposing edges 67 and 69 that are spaced apart from each other by a distance sufficient to pass a hasp U-shaped member when lock 11 is in the open position illustrated in FIG. 2. Lock 11 may have a closed position which is attained when the camming lock 21 is urged downwardly into the outer case 13 to cause the lower ends of shafts 43 and 45 to be locked within the inner lock 27, much the same as the shackle of a conventional padlock is secured. It is evident that downward movement of the camming block 21 from the position of FIG. 2 will cause the camming surfaces 35 and 37 to urge the pincher arms toward each other, bringing the opposite edges 67 and 69 of the blades fully together as FIG. 3 illustrates. Lock 11 may be released from the closed position shown in FIG. 3 by opening the inner lock 27 with a key in the conventional manner.

Figure 4:
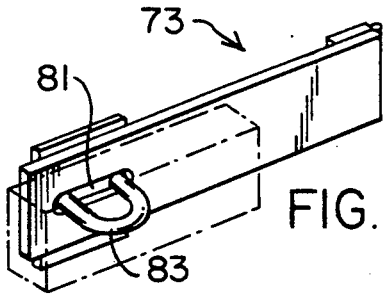
FIG. 4 is a perspective view illustrating application of the lock according to the present invention to a hasp-type latch.
Figure 5:
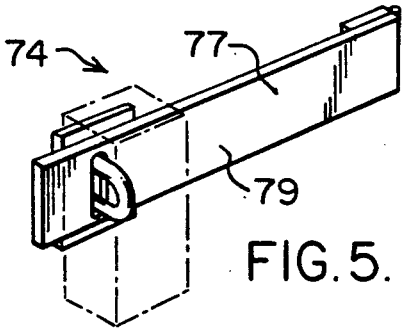
FIG. 5 is an illustration of application of a lock according to the invention over a variation of the conventional hasp-type latch.

The lock 11 may be used advantageously to secure conventional hasp-type assemblies such as assembly 73 shown in FIG. 4 and assembly 74 shown in FIG. 5. Latch assembly 74 includes a latch bar 77 having a vertically elongated slot that receives all appropriately aligned U-shaped member 79. The latch shown in FIG. 4 differs by having a latch bar with a horizontally elongated slot 81 and a U-shaped member 83 that fits through slot 81. In order to secure the latch 73, shown in FIG. 4, the lock 11 is first placed in its open configuration illustrated in FIGS. 1 and 2. The aperture 19 may then be aligned with the U-shaped member 83 and the member 83 inserted into the aperture and beyond the spread-apart blades 63 and 65 of the pincher arms, there being sufficient spacing behind the blades 63 and 65 for a segment of the U-spaced member. Lock 11 may then be urged to its locked configuration, shown in FIG. 3 where an illustrative U-shaped member 87 is secured by the closed blades 63 and 65. It can be appreciated by viewing FIG. 4 that when lock 11 is applied over latch 73 the U-shaped member 83 is shielded from cutting tools such as bolt cutters. FIG. 5 shows how lock 11 can also secure the latch 74 by securing the U-shaped member 79. Note that an additional advantage of the lock 11 is that the inner lock 27 is substantially shielded by the outer case, against moisture and weather, as well as against tampering, and additional weather proofing of lock 27 may be obtained by providing a moisture-proof key-way cover for the key-way of lock 27.

While a particular embodiment of the invention has been described herein it is not intended that the invention be limited thereto, since various modifications and changes may readily occur to those skilled in the art without departing from the invention. For example, a version of the invention can have pincher arms that are mounted to a single axle rather than two axles. Therefore it is aimed to cover all such changes and modifications as fall within the true spirit and scope of the invention as defined in the claims which follow.

What is claimed is:

1. Lock for use with a hasp-type latch assembly that has a U-shaped locking member, said lock comprising:

a) outer protective case including front wall, a rear wall spaced from said front wall, and spaced-apart side walls, said front wall having a vertically elongated aperture therein that is adapted to receive said U-shaped member;

b) inner lock having a case and locking mechanism within said case, said case having a top wall with a pair of spaced-apart bores therein, and said inner lock mounted within the lower portion of said outer case;

c) camming block slidably mounted within the upper part of said outer case for vertical movement, said block having a bottom wall and first and second connecting shafts extending vertically downwardly from said bottom wall and said shafts having lower end portions that are adapted to be received in said bores and at least one of said end portions adapted to make releasably lockable engagement with said locking mechanism, and whereby said block has a lowered, locked position in which said lower ends of said shafts are locked within said bores, and a raised, unlocked position, and said block having a vertically elongated cavity therein including a slot adapted to receive said U-shaped locking member, said cavity including a first camming surface laterally spaced apart from a second camming surface of said cavity; and d) first and second pincher arms, each one having a curved upper surface adapted to slidable engage one of said camming surfaces, a laterally projecting locking blade, and a lower end, and means adjacent the top of said inner lock for pivotally mounting the lower ends of said arms, and means for resiliently biasing said first arm away from said second arm so that the curved upper surfaces of said first and second arms are urged into engagement with said camming surfaces, and whereby said arms have an open position coinciding with the open position of said block, and in which said arms are divergent with respect to each other with said first locking blade spaced laterally from said second locking blade sufficiently to pass a segment of said locking member; said first blade positioned to one side of said aperture, and said second blade positioned to the other side of said aperture; and movement of said block to its locked position being operative to cause said first and second camming surfaces to urge said first and second arms towards each other and to a locked position in which said first and second blades are brought together such that a segment of said U-shaped member that is inserted in said outer case aperture when said block is in its raised position is secured by said blades against movement out of said aperture when said block is in its lowered position.

2. Lock as defined in claim 1 wherein said outer case, said inner lock and said block each has a generally rectangular cross sectional configuration.

3. Lock as defined in claim 1 wherein said outer case has a generally tubular configuration with a generally rectangular cross sectional configuration.

4. Lock as defined in claim 1 wherein said means for urging said arms apart comprises a spring.

5. Lock as defined in claim 1 wherein each of said curved surfaces slidably engages one of said camming surfaces.

6. Lock as defined in claim 1 wherein each said blade has a top edge, a bottom edge and a side edge.

7. Lock as defined in claim 6 wherein said blade side edges are brought into close proximity with each other when said block is in its lowered position.

8. Lock as defined in claim 2 wherein said inner case has a bottom wall containing a keyway.

9. Lock as defined in claim 1 wherein means for pivotally mounting the lower ends of said arms includes first and second parallel, spaced-apart axle pins.

10. Lock as defined in claim 1 wherein means for pivotally mounting each of the lower ends of said arms includes a single axle pin.

11. Lock as defined in claim 1 wherein said front wall is a major wall of said case and is generally flat and rectangular.

* * * * *